US009070997B2

(12) United States Patent
Spalding

(10) Patent No.: US 9,070,997 B2
(45) Date of Patent: Jun. 30, 2015

(54) MINING CABLE COUPLERS

(71) Applicant: Tyco Electronics Corporation, Berwyn, PA (US)

(72) Inventor: Matthew Spalding, Cornelius, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 238 days.

(21) Appl. No.: 13/692,401

(22) Filed: Dec. 3, 2012

(65) Prior Publication Data

US 2014/0017952 A1 Jan. 16, 2014

Related U.S. Application Data

(60) Provisional application No. 61/671,246, filed on Jul. 13, 2012.

(51) Int. Cl.

| | |
|---|---|
| ***H01R 24/00*** | (2011.01) |
| ***H01R 13/46*** | (2006.01) |
| ***H01R 13/52*** | (2006.01) |
| ***H01R 13/533*** | (2006.01) |
| *H01R 105/00* | (2006.01) |
| *H01R 24/28* | (2011.01) |

(52) U.S. Cl.

CPC ..... *H01R 13/46* (2013.01); *H01R 24/00* (2013.01); *H01R 2105/00* (2013.01); *H01R 13/521* (2013.01); *H01R 13/5219* (2013.01); *H01R 13/533* (2013.01); *H01R 24/28* (2013.01)

(58) Field of Classification Search

USPC ..... 439/660, 180, 186, 271, 272, 279, 274, 439/587, 606; 174/50.59, 74 R, 75 R, 72 A

See application file for complete search history.

(56) References Cited

U.S. PATENT DOCUMENTS

| | | | | |
|---|---|---|---|---|
| 5,447,453 | A | 9/1995 | Smith et al. | |
| 6,227,908 | B1 | 5/2001 | Aumeier et al. | |
| 6,943,298 | B2 * | 9/2005 | Nicholson | 174/74 R |
| 2009/0215307 | A1 | 8/2009 | Hughes | |

FOREIGN PATENT DOCUMENTS

| | | | |
|---|---|---|---|
| EP | 0225 190 | A2 | 6/1987 |
| GB | 2 119 178 | A | 11/1983 |

OTHER PUBLICATIONS

International Search Report and Written Opinion for PCT/US2013/050291 mailed Oct. 21, 2013.

* cited by examiner

*Primary Examiner* — Abdullah Riyami
*Assistant Examiner* — Harshad Patel
(74) *Attorney, Agent, or Firm* — Myers Bigel Sibley & Sajovec, PA

(57) ABSTRACT

A mining cable coupler includes a hollow body with an entrance fitting for an electrical cable at the a end of the body and an electrical connector mounting member having a plurality of electrical connector receiving apertures adjacent a second end of the body with electrical connectors mounted in corresponding ones of the receiving apertures. At least one of the electrical connector includes an elongate electrical conductor that has an exposed face at an end of the hollow body. An insulating material surrounds the electrical conductor. The insulating material defines a radiussed region on the exposed end face of the electrical connector that provides electrical stress relief at the exposed end face. The end of the electrical conductor with the exposed face includes either an electrically conductive pin portion protruding from the end face or a mating electrically conductive socket portion having an opening in the end face.

14 Claims, 3 Drawing Sheets

MINING CABLE COUPLERS

BACKGROUND OF THE INVENTION

The present invention relates to cable connectors and, more particularly, to cable connectors of the type used for electrical cables in the mining industry, which have insulators.

Heavy electrical cables are commonly used in the mining industry for powering equipment. Such cables are connected together by cable couplers or connectors. These are used in pairs, one coupler having a plurality of sockets which receive a plurality of plugs in a second coupler. The couplers may be mounted on skids so they can be pulled about the job site by means of the attached cables.

The plugs and sockets, both of which comprise elongated conductors, are usually surrounded by an insulator, typically having a cylindrical opening surrounding each of the conductors. These insulators are subject to failure due to accident or environmental conditions. This can lead to arcing across adjacent conductors or between one or more conductors and ground. An example of such a mining coupler is described, for example, in U.S. Pat. No. 5,447,453 ("the '453 Patent").

Mining couplers are adapted from other electrical market products. The mining industry has unique requirements, such as: dragging the "plug and play" connections protected by metal sleds behind equipment, quick and reliable connect and disconnect, high environmental contamination and must operate near the rated current/power levels. These requirements differ from many electric utility applications such as underground residential distribution (URD). Electric utility market models of "plug and play" designs for applications such as underground residential distribution generally do not see full current loading, are in relatively clean environments and the mechanical duty requirements are relatively low compared to mining Many of the harsh service environment requirements in mining are met by protecting the electrical connector through the use of a metallic case.

SUMMARY OF THE INVENTION

Embodiments of the present invention provide a mining cable coupler including a hollow body having a first end and a second end. An entrance fitting for an electrical cable is at the first end of the body. An electrical connector mounting member having a plurality of electrical connector receiving apertures is adjacent the second end of the body. A plurality of electrical connectors are mounted in corresponding ones of the receiving apertures. At least one of the electrical connectors includes an elongate electrical conductor and an insulating material. The elongate electrical conductor extends from a first end in the hollow body that is configured to electrically connect to an electrical cable received through the entrance fitting to an opposite second end that has an exposed face at the second end of the hollow body. The first end of the electrical conductor is closer to the first end of the hollow body than the second end of the electrical conductor. The insulating material surrounds the electrical conductor. At the second end of the electrical conductor, the insulating material defines a radiussed region on the exposed end face of the electrical connector that provides electrical stress relief at the exposed end face. The second end of the electrical conductor includes either an electrically conductive pin portion protruding from the end face or a mating electrically conductive socket portion having an opening in the end face.

DETAILED DESCRIPTION OF EMBODIMENTS OF THE INVENTION

Figure 1:
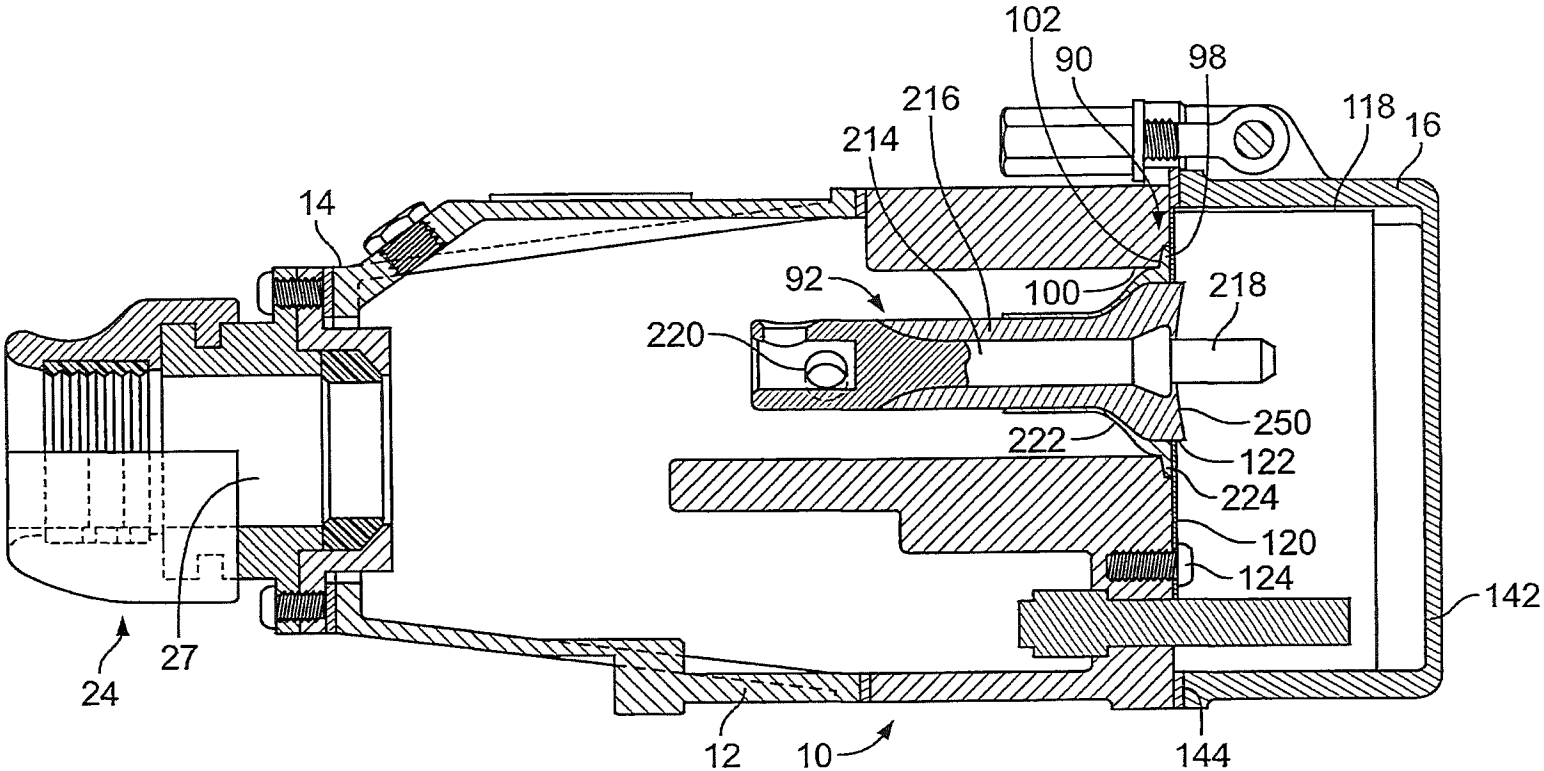
FIG. 1 is a side cross-sectional view illustrating a mining coupler with male plugs according to some embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Figure 2:
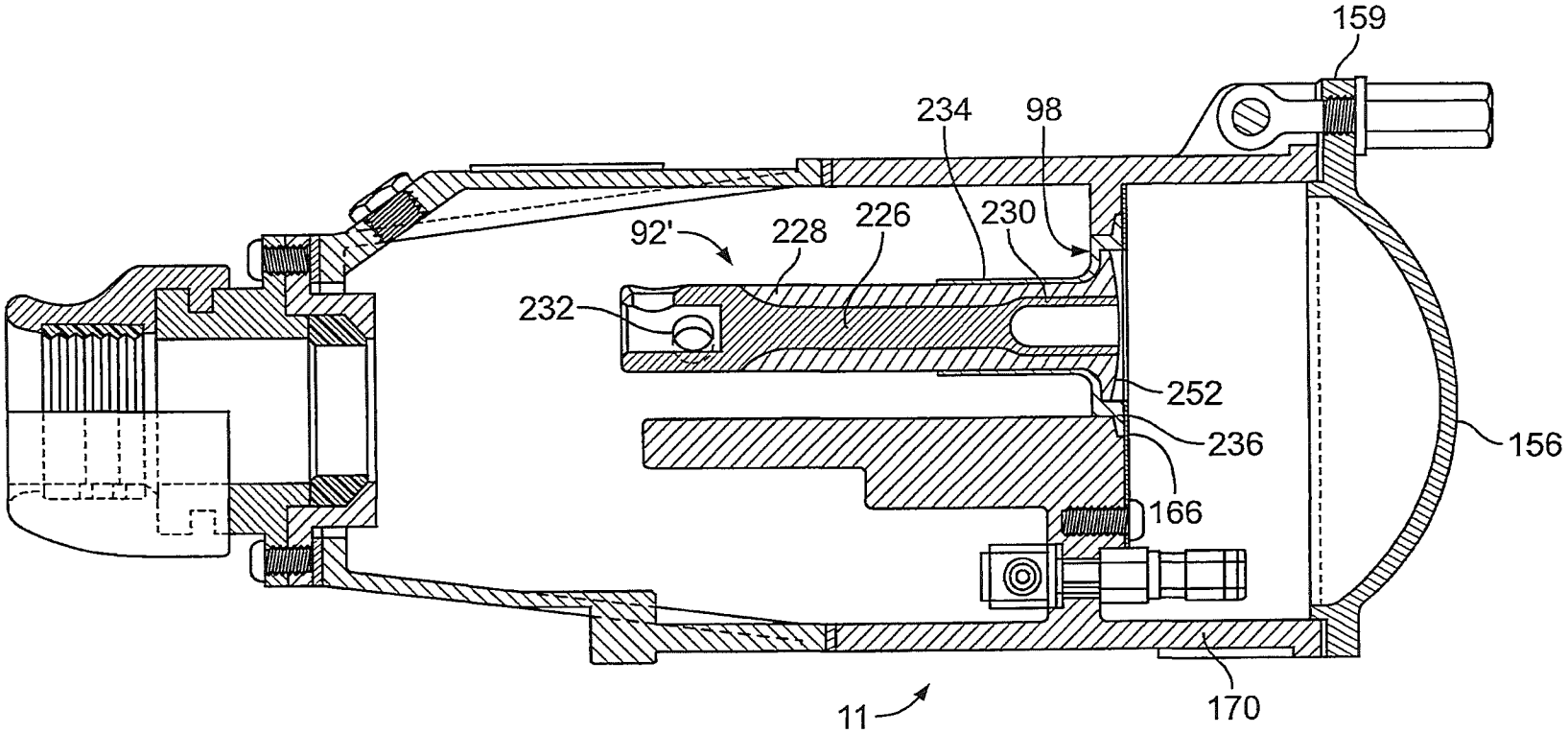
FIG. 2 is a side cross-sectional view illustrating a mining coupler with female sockets according to some embodiments of the present invention.
Figure 4:
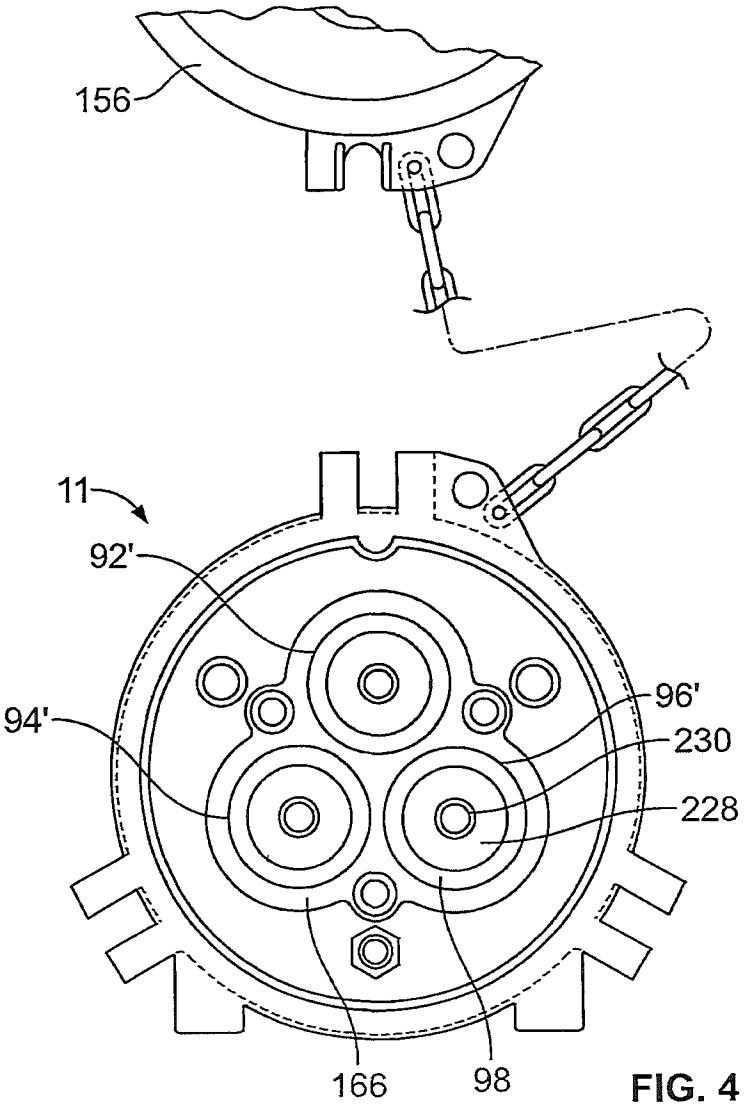
FIG. 4 is a front plan view of the mining coupler of FIG. 2 with the cover thereof removed.
Figure 3:
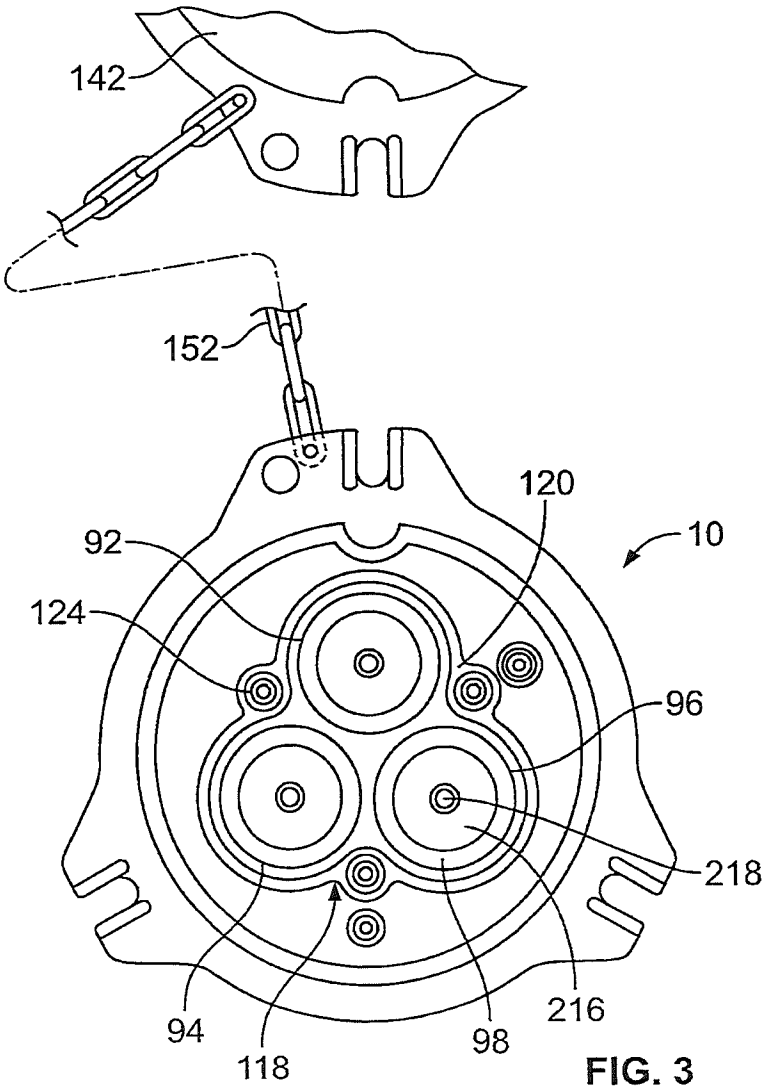
FIG. 3 is a front plan view of the mining coupler of FIG. 1 with the cover thereof removed.

Some embodiments of mining couplers will now be described with reference to FIGS. 1 to 4. The coupler shown in FIGS. 1 and 3 is generally the same as that in the embodiments of FIGS. 2 and 4, however, the former includes male plugs adapted to be received in the female sockets of the latter. These embodiments are shown in FIGS. 1 and 2 with protective covers 142, 156 in place. In normal use these covers would be removed and the complementary couplers mutually engaged to connect together two different mining cables. Because of their similarities, the embodiments are chiefly described with reference only to the embodiment of FIGS. 1 and 3.

Referring now to FIGS. 1 and 3, the mining cable coupler 10 includes a hollow body 12, which may be a metal such as aluminum. The body may be generally cylindrical and has a first end 14 and a second end 16 displaced longitudinally (along the axis of the cable using the coupler) from the first end 14.

An entrance fitting 24 is shown at the first end 14 of the body 12 that receives an electrical cable. The cable is received through a cylindrical interior opening 27. Seals and other features of the entrance fitting 24 are shown, which are more fully described, for example, in the '453 Patent. Other types of entrance fittings may be used with embodiments of the present invention.

Also shown in the embodiments of FIGS. 1 and 3 is an insulated connector member mount, shown generally at 90, for mounting a plurality of insulated connector members, such as connector member 92 shown in FIG. 1 (see also, connector member 92' in FIG. 2), adjacent the second end 16 of the body. In the illustrated embodiments, there are three such connector members 92, 94 and 96, shown in FIG. 3, as is conventional for mining cable couplers of this type. The connector members 92, 94, 96 are illustrated as arranged at the corners of an equilateral triangle. Unlike conventional mining coupler insulators, which include tubular insulators as seen in the '453 Patent, the connector members 92, 94, 96 (92', 94', 96') include a ball (convex end face) 92', 94', 96' and cup (concave end face) 92, 94, 96 insulator configuration such as that more fully described in the context of the electrical connection disclosed in U.S. Pat. No. 6,227,908 ("the '908 Patent").

The connector member mount 90 is shown as a generally round, plate-like member. The three connector members 92, 94, 96 are received in respective circular apertures through the connector member mount 90. Aperture 100 for connector member 92 can be seen in FIG. 1 (See, also, connector member 92' in FIG. 2). The other apertures are the same, and are spaced-apart at the corners of an equilateral triangle to correspond with the positions of the connector members shown in FIG. 3. There is an annular recess 102 about each aperture, 100 on the side of mount 90 facing end 16 of the body. The recess is dimensioned to be complementary in shape and configuration to the shoulder 98 of each connector member so the shoulder can be closely received within the recess as shown for connector member 92 in FIG. 1.

An O-ring may be compressingly received between each insulator and the corresponding aperture in mount 90. These O-rings may serve to seal about each of the insulators and may seal the inside of the body 12 from moisture, dirt and other contaminants.

Connector member 92 has a metal conductor 214 extending therein within insulating material 216 with a pin 218 protruding therefrom at one end. At its other end, beyond the insulating material 216, the connector member 92 terminates in a socket 220 for receiving the conductor of a high voltage cable received into the hollow body 12 through the opening 27. At the pin end of the connector member 92, the insulation 216 is radially enlarged and may carry a conductive screening layer 222 on its outer surface, the layer terminating in a radial flange 224 that defines the shoulder 98. The conductor 214 may be radially enlarged and radiussed (concave in FIG. 1) within the insulation 216 adjacent the pin 218 on the end face 250, so as to distribute electrical stress more evenly over the exposed annular end surface face 250 (i.e., the "cup" of the ball and cup insulator interface after forming an electrical connection) of the insulation 216. Many existing medium voltage insulating materials may be used for the insulation 216, 228. Examples of suitable materials include silicone rubber and ethylene propylene diene monomer (M-class) rubber (EPDM). Mixtures could also be utilized for the dielectric. High or medium current/voltage pin and socket connectors could be employed based on the connection requirements.

Referring now to FIG, 2, the connector member 92' (i.e., female connector member) has a corresponding metal conductor 226 encased within insulating material 228. The conductor 226 terminates at one end in a socket 230 that is configured to receive the pin 218, and at its other end is a socket 232 for receiving the conductor of another cable. The connector member 92' may also be provided with an outer conductive screening layer 234 terminating in a flange 236 (defining the shoulder 98) at a radially-enlarged (convex in FIG. 2) insulating portion around the socket 230 (i.e., the "ball" of the ball and cup insulator interface) at an end face 252 of the connector member 92'.

The exposed mating annular surface faces 250, 252 of the connector members 92, 92' are curved (radiussed) so as to assist in the exclusion of air pockets at the interface when the pin 218 is fully mated within the socket 230 and when the outer flanges 224 and 236 are in abutment. The curved insulating interface may be offset from the annular interface of the flanges 224, 236 so as to avoid a direct path from outside the connector members 92, 92' to the inner high voltage conductor connection. Conductive layers 222 and 234, together with the flanges 224, 236 may provide screening of the interconnection.

A compact, low profile, screened and stress controlled in-line splice can thus be formed by the coupling of the electrical connector members 92, 92' when respective cables are connected to the sockets 220 and 232 thereof.

Referring again to FIG. 1, the coupler may also include a securing member 118 which may serve in part to releasably secure the connector members to mount 90. The member 118 has an inner portion 120, shown in FIGS. 1 and 3, which may be held tightly against mount 90 by releasable fasteners, in this instance by three bolts 124. There are three apertures 122 extending through inner portion 120 corresponding in position to each of the connector members 92, 94 and 96. The apertures 122 may be slightly larger than end faces 250, 252 of the insulating material 216 apart from the shoulders 98 thereof. The apertures are smaller than the shoulders 98 and therefore the securing member 118 presses against the shoulders of the connector members to releasably secure them within the grooves 102 in the insulator mount 90 when the bolts 124 are tightened. Inner portion 120 then tightens against both the shoulders 98 of the connector members and the mount 90. The securing member 118 may be made of metal.

FIG. 1 also shows a cap 142 fitted over the second end 16 of the body 12. A chain 152 may be used to connect the cap to the body 12, as seen in FIG. 3, so the cover is not lost when removed from the end 16 of the body as shown in FIG. 3. The cover is thus removed in order to connect coupler 10 with coupler 11 shown in FIG. 2.

Coupler 11, as mentioned above, is generally similar to coupler 10 and therefore is described only with respect to the differences therebetween. In the case of coupler 11, cap 156 for this coupler is instead provided with the spaced-apart lugs 159 which to attach to the body of the coupler 10. The cap 156 is removed in order to connect coupler 10 to coupler 11. As discussed above, coupler 11 has three female sockets 230 configured to receive the male plugs 218 of coupler 10. There are three such sockets that are arranged and spaced-apart in the same manner as the male plugs so as to allow all three connections to be concurrently formed by a simple longitudinal insertion.

A securing member 166 of the coupler 11 is flat and plate-like. With no outer tubes surrounding the insulator.

After the covers are removed, the couplers can be fitted together, end 170 of coupler 11 being larger in diameter than end 16 of coupler 10 so the latter receives the former therein up to shoulder 144 of coupler 10. The couplers 10, 11 may then be tightened together by a bolt as illustrated to hold the couplers together.

As described above, embodiments of the present invention adapt a ball and cup configuration connector to provide improved mining couplers. These connectors include a male and female dielectric interface with the abutting faces thereof in a ball and cup relationship for the interface between the dielectrics with the power passed through a center pin (plug) and socket connector. It will be understood that, while the plug is shown as having the concave end face 250, in other embodiments the plug has a convex end face and the mating socket has a concave end face 252.

Many existing mining couplers, equipment plug ports and supply plug ports utilize male and female tubular or conical bushings similar to the electric utility load break and dead break 200 A, 250 A & 600 A 15 kV-35 kV designs. While this design may be acceptable for the electrical utility application of connecting one phase at a time, the mechanical, environmental and service requirements are moderate. Mining applications, such as described in the '453 Patent, generally require all 3 phases to be connected at once with a long longitudinal interface between the insulating dielectrics in harsh environments. The tough service conditions for these conventional couplers all contribute to damage and electrical breakdown with this configuration.

The ball and cup configuration of some embodiments of the present invention may provide a quicker and easier make and break interface as compared to the relatively large surface area of three tubular or conical bushings and rubbing of the dielectrics during insertion of the connectors. Bending moments and torques would be limited as the make and break of the electrical connection would require much less "X" axis or longitudinal movement because the insulating dielectric interface is now more along the "Y" axis or normal to the make and break axis as seen in FIGS. 1 and 2.

In some embodiments, connector members as described herein could be used to adapt existing couplers one phase at a time if one coupler insulator was damaged. A female dielectric cup would be put on the appropriate coupler connector and the male on the other. The interface between the existing couplers around the damaged insulator could be accomplished by mechanical force or pressure of mating the outer coupler housings or high dielectric grease or high dielectric gel. The same method could be applied phase by phase or with a 3 phase retrofit design if the entire already in use coupler was to be converted, In some embodiments of the present invention, the electrical connection may be protected from excessive mechanical dielectric and connector forces by the coupler housing making the ball and cup configuration described herein an excellent medium voltage power connection for this mining coupler application.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed:

1. A mining cable coupler, comprising:

a hollow body having a first end and a second end;

an entrance fitting for an electrical cable at the first end of the body;

an electrical connector mounting member having a plurality of electrical connector receiving apertures adjacent the second end of the body; and a plurality of electrical connectors mounted in corresponding ones of the receiving apertures, each of the electrical connectors comprising:

an elongate electrical conductor extending from a first end in the hollow body that is configured to electrically connect to an electrical cable received through the entrance fitting to an opposite second end that has an exposed end face at the second end of the hollow body, wherein the first end of the electrical conductor is closer to the first end of the hollow body than the second end of the electrical conductor; and an insulating material surrounding the electrical conductor, wherein at the second end of the electrical conductor the insulating material defines a radiussed region on the exposed end face of the electrical connector that provides electrical stress relief at the exposed end face and wherein the second end of the electrical conductor includes either an electrically conductive pin portion protruding from the end face or a mating electrically conductive socket portion having an opening in the end face;

wherein:

the radiussed region comprises either a concave or a convex region;

the electrical connector mounting member comprises a substantially flat mounting plate;

the electrical connector receiving apertures are defined in the mounting plate; and a plurality of annular recesses are defined between the mounting plate and the second end of the hollow body with one of the annular recesses surrounding a respective one of the electrical connector apertures.

2. The mining cable coupler of claim 1, wherein the electrical conductor comprises a medium voltage conductor.

3. The mining cable coupler of claim 1, wherein the electrical conductor comprises a high voltage conductor.

4. The mining cable coupler of claim 1, wherein the insulating material comprises at least one of silicone rubber and ethylene propylene diene monomer (M-class) rubber (EPDM).

5. The mining cable coupler of claim 1, wherein the electrical conductor includes the conductive pin portion and wherein the mining cable coupler further comprises a mating mining cable coupler, wherein the mating mining cable coupler comprises:

a second hollow body having a first end and a second end;

a second entrance fitting for an electrical cable at the first end of the second body;

a second electrical connector mounting member having a plurality of electrical connector receiving apertures adjacent the second end of the second body; and a plurality of mating electrical connectors mounted in corresponding ones of the receiving apertures, each of the mating electrical connectors comprising:

a mating elongate electrical conductor extending from a first end in the second hollow body that is configured to electrically connect to an electrical cable received through the second entrance fitting to an opposite second end that has an exposed end face at the second end of the second hollow body, wherein the first end of the mating electrical conductor is closer to the first end of the second hollow body than the second end of the mating electrical conductor; and a mating insulating material surrounding the mating electrical conductor, wherein at the second end of the mating electrical conductor the mating insulating material defines a radiussed region on the exposed end face of the mating electrical connector that provides electrical stress relief at the exposed end face and wherein the second end of the mating electrical conductor includes a mating electrically conductive socket portion having an opening in the end face, wherein one of the exposed end faces of the electrical conductor or the mating electrical conductor is a convex region and the other is a concave region having matched curvatures to provide an even abutting contact therebetween when the pin portion is fully inserted in the socket portion.

6. The mining cable coupler of claim 5, wherein the mating mining cable coupler is configured to receive an electrical cable in the second entrance fitting from an energized power source and wherein the mining cable coupler is configured to receive an electrical cable in the entrance fitting thereof from an un-energized electrical device.

7. The mining cable coupler of claim 5, wherein:

the exposed end face and the conductive pin portion of a respective mining cable coupler electrical connector extends through a corresponding one of the apertures of the mining cable coupler mounting member toward the second end of the hollow body; and the exposed end face and the conductive pin portion of a respective mining cable coupler electrical connector are received through a corresponding one of the apertures of the mating mining cable coupler mounting member toward the first end of the second hollow body when the pin portion is fully inserted in the socket portion.

8. The mining cable coupler of claim 1, wherein the plurality of electrical connectors each further comprise a conductive layer extending over an outer surface of the insulating material at the second end of the electrical conductor that provides electrical screening for the electrical connector.

9. The mining cable coupler of claim 1, wherein:

the insulating material comprises a radially enlarged portion that defines an annular shoulder adjacent the second end of the electrical conductor; and a respective shoulder is received in a corresponding one of the annular recesses.

10. The mining cable coupler of claim 9, wherein the radially enlarged portion increases in radius from a central portion of the electrical conductor toward the second end of the electrical conductor and has a maximum radius at the shoulder.

11. The mining cable coupler of claim 9, further comprising a conductive layer that extends over an outer surface of the radially enlarged portion.

12. The mining cable coupler of claim 9, further comprising a securing member held against the mounting plate, wherein the securing member secures the annular shoulders in the annular recesses.

13. The mining cable coupler of claim 12, wherein the securing member comprises a plurality of apertures that are aligned with the electrical connector receiving apertures of the mounting plate, and wherein a portion of a respective electrical connector extends through a corresponding one of the apertures of the securing member toward the second end of the hollow body.

14. The mining cable coupler of claim 1, wherein the exposed end face and the second end of a respective electrical conductor extends through a corresponding one of the apertures of the mining cable coupler mounting member toward the second end of the hollow body.

* * * * *